US005205111A

United States Patent [19]

Johnson

[11] Patent Number: 5,205,111

[45] Date of Patent: Apr. 27, 1993

[54] PACKAGING METHOD FOR A LEVEL AND CASE

[75] Inventor: Robert A. Johnson, Mequon, Wis.

[73] Assignee: Johnson Level & Tool Mfg. Co., Inc., Mequon, Wis.

[21] Appl. No.: 689,363

[22] Filed: Apr. 22, 1991

Related U.S. Application Data

[62] Division of Ser. No. 368,670, Jun. 20, 1989, Pat. No. 5,027,951.

[51] Int. Cl.[5] ..... B65B 5/02; B65B 5/08; B65B 43/08

[52] U.S. Cl. ..... 53/456; 53/445; 53/467; 53/474

[58] Field of Search ..... 53/399, 397, 445, 447, 53/474, 456, 458, 413, 467, 444, 452

[56] References Cited

U.S. PATENT DOCUMENTS

| | | | |
|---|---|---|---|
| 100,676 | 3/1870 | Shaw | 229/125.31 |
| 2,588,232 | 3/1952 | Grant | 229/125.31 |
| 2,676,749 | 4/1954 | Argodale | 229/125.28 |
| 2,835,381 | 5/1958 | Ackermann et al. | 206/443 |
| 2,971,641 | 2/1961 | Griem | 53/447 X |
| 3,342,322 | 8/1967 | Weisner et al. | 229/125.31 |
| 4,378,923 | 4/1983 | Takei | 206/443 |
| 4,759,446 | 7/1988 | Dobashi et al. | 53/399 X |
| 4,871,068 | 10/1989 | Dreyfus | 53/413 X |

FOREIGN PATENT DOCUMENTS

| | | | |
|---|---|---|---|
| 684132 | 4/1964 | Canada | 206/361 |

*Primary Examiner*—Horace M. Culver

*Attorney, Agent, or Firm*—Andrus, Sceales, Starke & Sawall

[57] ABSTRACT

An apparatus and method for packaging articles includes a tray having a cavity adapted to receive the one or more articles therein. The cavity is defined by a pair of upstanding side walls, which extend slightly above the upper surface of the one or more articles when placed within the cavity. A retainer is adapted for securement to the upstanding side walls, and retains the one or more articles within the cavity. The retainer prevents outward movement of the articles from the cavity, and leaves a major portion of the articles exposed after packaging for viewing by a potential consumer.

8 Claims, 2 Drawing Sheets

PACKAGING METHOD FOR A LEVEL AND CASE

CROSS-REFERENCE TO RELATED APPLICATION

This application is a division of application Ser. No. 07/368,670 filed Jun. 20, 1989, now U.S. Pat. No. 5,027,951.

BACKGROUND AND SUMMARY

This invention relates to packaging, and more particularly to a system for packaging one or more elongated articles in which one face of the package is exposed so as to allow the articles to be viewed when packaged.

Articles such as a level for use by a mason or carpenter are often sold alone, and are displayed for sale simply by hanging the levels on a hook. It has been found, however, that many users prefer to store the level in a case when not in use. Such a case is illustrated, for example, in U.S. Pat. No. Des. 293,044 issued Dec. 8, 1987.

In the past, the level and case have been sold separately because there was no satisfactory known system for presenting both items to the potential purchaser in a single package. The present invention addresses this problem.

In accordance with the invention, a packaging apparatus for one or more articles, such as a level and case, comprises a tray including a cavity adapted to receive the one or more articles therein, with the tray including a pair of spaced upstanding walls. Retainer means is adapted to be secured to the tray, and includes a pair of end portions each adapted for interconnection with one of the upstanding walls, and a portion spanning between the end portions. The spanning portion of the retainer means is adapted to overlie the cavity after placement of the one or more articles therein for retaining the articles within the cavity. A major portion of the length of the articles is exposed after placement of the retainer means on the tray, so as to allow the potential purchaser to view the articles as packaged. The contour of the tray cavity preferably corresponds to that of the articles received therein when placed side by side. The upstanding walls of the tray preferably extend slightly above the upper surface of the one or more articles received within the cavity. The spanning portion of the retainer means then spans between the upper ends of the upstanding walls and is spaced slightly above the upper surface of the articles for maintaining the articles within the cavity. To ensure that the articles received within the tray cavity are maintained in position, top and bottom end portions which overlie the cavity after placement of the articles therein are provided on the tray. The space between the top and bottom end portions is preferably slightly less than the shortest article received within the tray cavity, to ensure that the articles remain therewithin. The retainer means preferably comprises a pair of ears and a header extending therebetween, with the ears each being adapted to be received within a slot provided in the upper face of each upstanding wall. In a preferred embodiment, the ears are formed with a self-locking structure to affix the retainer means to the upstanding tray side walls. In an alternate embodiment, the ears are simply received within the slots in the upper faces of the upstanding tray side walls and an adhesive strip used to secure the retainer means to the tray.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
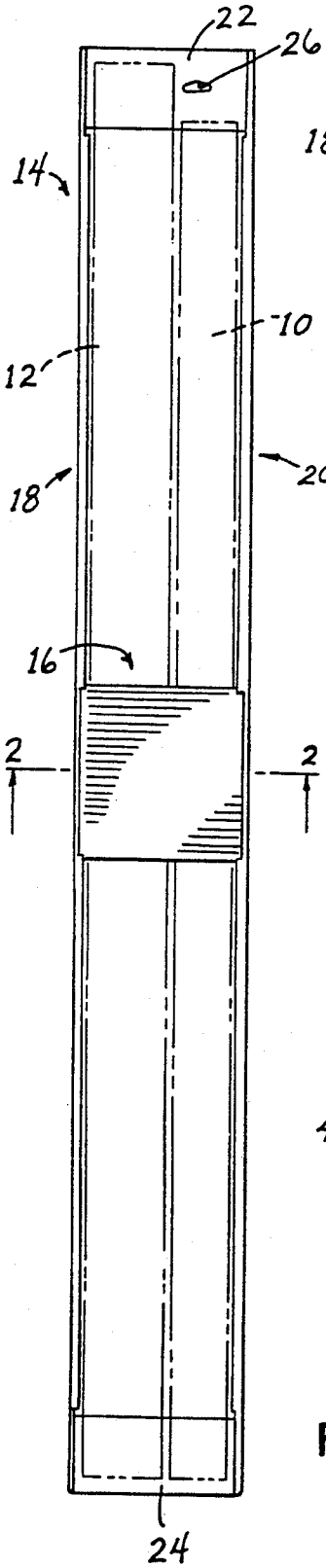
FIG. 1 is a front elevation view showing the packaging apparatus of the invention for packaging a level and case, shown in phantom.
Figure 2:
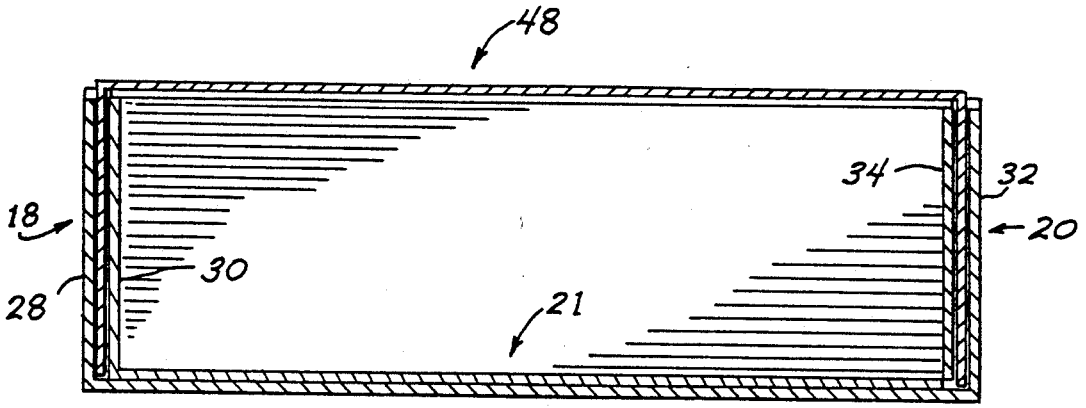
FIG. 2 is a sectional view taken generally along line 2—2 of FIG. 1.

As shown in FIG. 1, an apparatus for packaging a pair of side-by-side elongated articles, such as a level shown in phantom at 10 and a case therefore shown in phantom at 12, includes a tray 14 and a retainer 16. Both tray 14 and retainer 16 are preferably constructed from a folded corrugate material. Tray 14 has a pair of spaced side walls, shown at 18, 20, projecting upwardly from a rear wall 21 (FIG. 2). Rear wall 21 and side walls 18, 20 define a cavity adapted to receive level 10 and case 12 in a side-by-side relationship.

The upper end of tray 14 includes an upper retainer 22. Similarly, the lower end of tray 14 includes a lower retainer 24, constructed similarly to upper retainer 22. When tray 14 is stood on end with level 10 and case 12 placed therein, as shown in FIG. 1, it is seen that the lower end of level 10 and case 12 are both received within a pocket formed at the lower end of tray 14, the outer surface of which is defined by lower retainer 24. In a similar manner, the upper ends of level 10 and case 12 are received within a pocket provided at the upper end of tray 14, the outer surface of which is defined by upper retainer 22. Level 10 is typically shorter in length than tray 12, as shown, and when tray 14 is positioned in its FIG. 1 position, the upper end of level 10 projects above the lower edge of upper retainer 22. In this manner it is ensured that, whether tray 14 is positioned upside down or right side up, the ends of level 10 and case 12 are always contained within the pockets provided at the upper and lower ends of tray 14.

As shown in FIG. 1, an opening. 26 extends through upper retainer 22 and rear wall 21 of tray 14. Opening 26 receives a hook utilized to display the level and case as packaged within tray 14 in a retail outlet or the like. Opening 26 is off center relative to the longitudinal axis of tray 14, and is positioned over level 10. The position of opening 26 is governed by the relative weights of level 10 and case 12, in that level 10 is typically substantially heavier than case 12. Accordingly, positioning of opening 26 as shown prevents tray 14 from listing to one side when placed on a hook.

Figure 3:
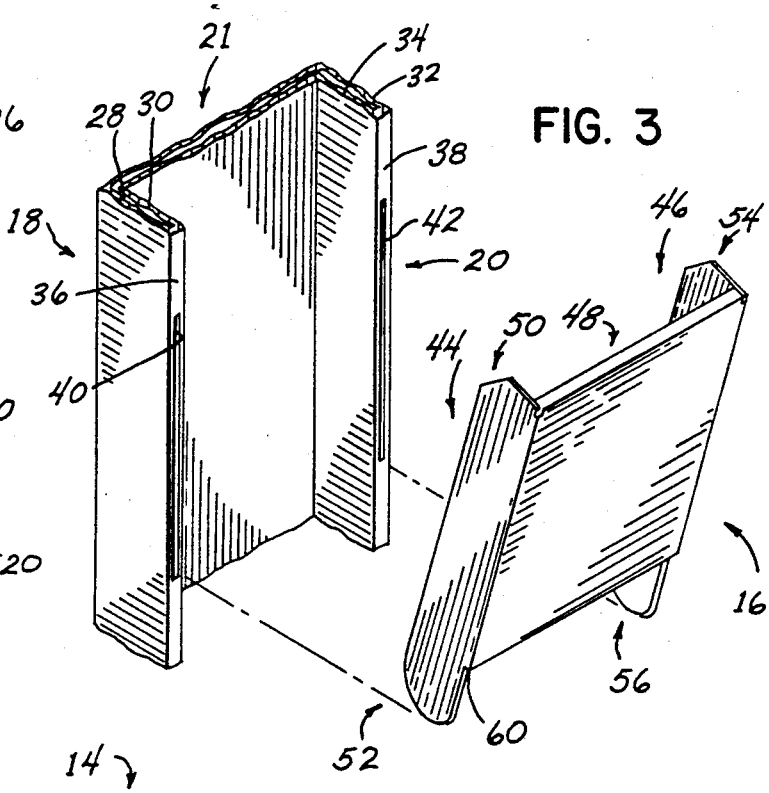
FIG. 3 is an exploded partial isometric view showing the self-locking embodiment of the retainer means and the retainer means prior to securement to the tray side walls.

Referring to FIGS. 2 and 3, side wall 18 consists of an outer web 28 and an inner web 30, with a space disposed therebetween. Similarly, side wall 20 consists of spaced outer and inner webs 32, 34. An upper surface 36 connects the upper ends of webs 28, 30 and an upper surface 38 connects the upper ends of webs 32, 34. Slots 40, 42 are formed in side wall upper surfaces 36, 38, respectively. Slot 40 opens into the space between webs 28, 30 of side wall 18, and slot 42 opens into the space between webs 32, 34 of side wall 20.

Referring to FIG. 3, retainer 16 includes a pair of ears 44, 46 between which a header portion 48 extends. Ears 44, 46 are identical in construction, and are adapted to be received within slots 40, 42, respectively. Ear 44 includes an upper locking portion 50 and a lower locking portion 52, and ear 46 likewise includes an upper locking portion 54 and a lower locking portion 56.

Figure 4:
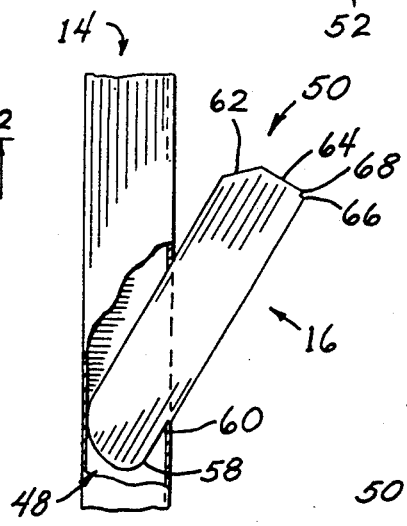
FIG. 4 is a partial side elevation view, with portions broken away, showing the retainer means of FIG. 3 partially engaged with the upstanding tray side walls.
Figure 5:
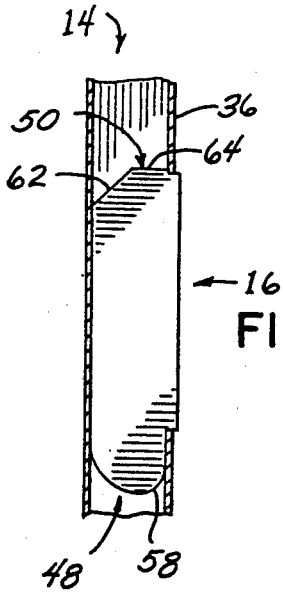
FIG. 5 is a view similar to FIG. 4, showing the retainer means fully engaged with the tray side walls.

With reference to FIGS. 4 and 5, the interlocking of upper and lower locking portions 50, 52 of ear 44 will be explained relative to side wall 18. It is to be understood, of course, that the same description applies for the interrelationship of ear 46 with side wall 20. As shown, lower locking portion 52 of ear 44 includes a depending tab 58 which is adapted for placement into slot 40 at its lower end, which is received in the space between outer and inner webs 28, 30 of side wall 18. Tab 50 is positioned within slot 40 such that a shoulder 60 located at the same elevation as the lower edge of header 48 engages the lowermost point of slot 40. A push-on force is then exerted on the upper end of retainer portion 16 such that a ramp 62 provided on upper locking portion 50 engages the uppermost wall of slot 40. An upper surface 64 of upper locking portion 50 then rides along the upper wall of slot 40. This action continues until the entirety of upper surface 64 has passed through slot 40 and the position as shown in FIG. 5 is attained. In this position, an upper shoulder 66 abuts the uppermost wall defining slot 40.

The longitudinal extent of header 48, which is disposed between lower shoulder 60 and upper shoulder 66, is substantially equal to the longitudinal dimension of slots 40, 42. In this manner, the upper surface of header 48 forms upper shoulder 66, and the lower surface of header 48 forms lower shoulder 60. As shown in FIG. 5, an outwardly facing surface 68 provided adjacent shoulder 66 engages the underside of upper surface 36 of side wall 18, and likewise the outwardly facing surface of tab 54 engages the underside of upper surface 36 below the lowermost point of slot 40. In this manner, retainer 16 is locked in place on tray 14, and little or no longitudinal or outward movement of retainer 16 relative to tray 14 is possible. It is understood, however, that an adhesive or other satisfactory means could be utilized to ensure that retainer portion 16 is firmly secured to tray portion 14.

Figure 6:
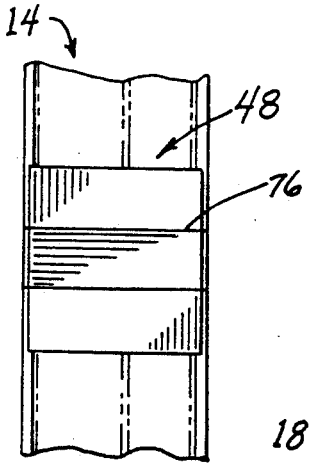
FIG. 6 is a partial front elevation view of an alternate embodiment of the packaging apparatus of the invention in which the retainer means is secured to the tray by means of an adhesive strip.
Figure 7:
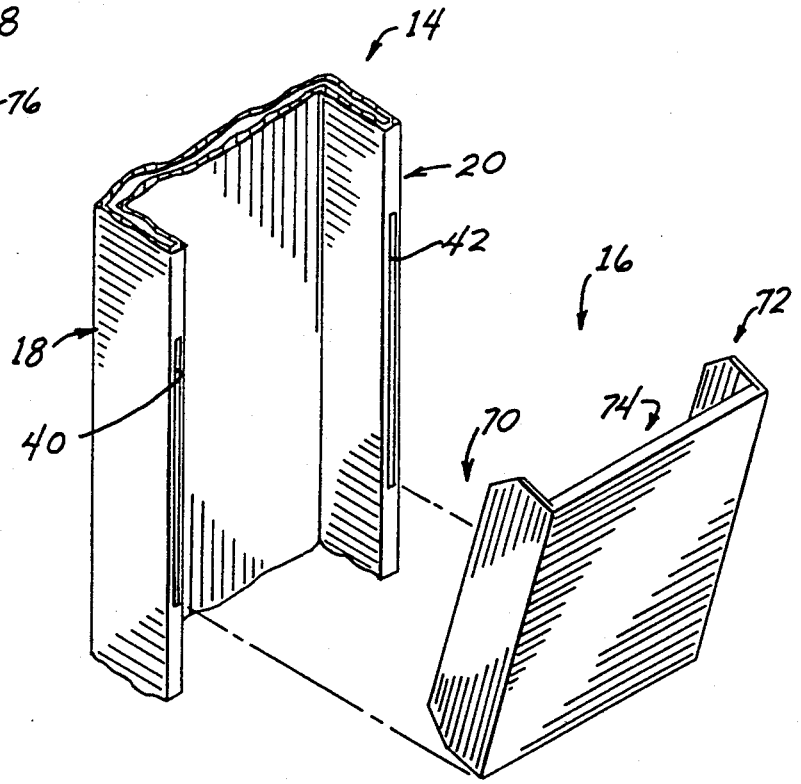
FIG. 7 is a view similar to FIG. 3, but showing the alternate embodiment of the retainer means.

FIGS. 6 and 7 illustrate an alternative construction of retainer 16, and like reference characters will be utilized where possible to facilitate clarity. As shown in FIG. 7, retainer 16 includes a pair of ears 70, 72, between which a header portion 74 extends. In this embodiment, the longitudinal dimension of ears 70, 72 is substantially equal to that of slots 40, 42. Accordingly, to secure retainer 16 to tray 14, ears 70, 72 are simply mated with slots 40, 42, and a strip of adhesive, such as tape or the like shown at 76 (FIG. 7) is placed over header 74 so as to secure retainer 16 to side walls 18, 20. While this apparatus and method provides a satisfactory packaging system, the additional step of applying strip 76 in completing the packaging has been found detrimental.

With either embodiment of retainer 16, it is seen that a major portion of level 10 and case 12 are exposed after packaging. This allows the potential consumer to thoroughly inspect these items before purchase.

Various alternatives and modifications are contemplated as being within the scope of the following claims particularly pointing out and distinctly claiming the subject matter regarded as the invention.

I claim:

1. A method of packaging a level and a case for the level for shipping and display of the level and case prior to purchase by a consumer, wherein the case is adapted to receive and enclose the level when the level is not in use, the method comprising the steps of:

providing a tray defining a pair of spaced walls, each wall having a slot formed therein;

positioning the level and case next to each other in a side-by-side manner within the tray between the spaced walls;

retaining the level and case within the tray, so as to maintain the level and case in a side-by-side manner during shipping and display of the level and case, by providing a retainer member having a pair of spaced ears, each ear defining a first end and a second end, and engaging the retainer member with the tray by positioning the first end of each retainer member ear within the slot formed in one of the spaced walls toward one end of the slot, and pivoting the second end of each retainer member ear downwardly toward the opposite end of the slot, to engage the first and second ends of each ear with one of the spaced walls adjacent the slot formed therein; and constructing the tray and the retainer member such that a portion of the level and case are visible, to allow visual access to the level and case when retained within the tray.

2. The method of claim 1, wherein the step of positioning the level and case comprises placing the level and case in a side-by-side manner against a rear panel defined by the tray.

3. The method of claim 1, wherein visual access to the level and case is provided by constructing the retainer member such that it extends less than the full length of the tray assembly to provide visual access to the level and case above and below the retainer.

4. The method of claim 3, further comprising the step of constructing the tray to provide a pair of end retainers which overlie the ends of the level and case when the level and case are positioned within the tray, to maintain the ends of the level and case therewithin.

5. The method of claim 4, wherein the step of engaging the retainer member with the spaced walls of the tray comprises locating the retainer member substantially centrally between the end retainers, and wherein a major portion of the length of the level and case is visible in spaces located between the retainer and the end retainers.

6. A method of packaging a level and a case for the level for shipping and display of the level and case prior to purchase by a consumer, wherein the case is adapted to receive and enclose the level when the level is not in use, and wherein the weight of one of the level and case is greater than that of the other of the level and case, the method comprising the steps of:

positioning the level and case next to each other in a side-by-side manner against a panel;

retaining the level and case in position on the panel, whereby the center of gravity of the level and case is offset from the center of the panel toward the heavier of the level and case; and providing a hanging means associated with the panel for allowing the panel to be suspended from a hook or the like to display the level and case, and positioning the hanging means substantially in alignment with the center of gravity of the level and case to allow the panel to hang substantially vertically when suspended by operation of the hanging means.

7. The method of claim 6, wherein the hanging means includes an opening located toward the upper end of the panel to receive a hook therethrough for allowing display of the level and case.

8. The method of claim 7, wherein the upper end of the level is located below the upper end of the case when the level and case are positioned in a side-by-side manner within the package, and wherein the opening formed in the rear panel is disposed above the level and spaced from the side of the case adjacent the level.

* * * * *